United States Patent [19]

Garcea

[11] 3,956,433

[45] May 11, 1976

[54] AUTOMATIC DEVICE FOR EQUALIZING THE ADJUSTMENT OF THE CARBURETTER TO THE OPERATION OF AN ENGINE NOT YET RUNNING AT A STEADY TEMPERATURE

[75] Inventor: Giampaolo Garcea, Milan, Italy

[73] Assignee: Alfa Romeo S.p.A., Milan, Italy

[22] Filed: July 29, 1974

[21] Appl. No.: 492,913

[30] Foreign Application Priority Data

July 30, 1973 Italy ..... 27297/73

[52] U.S. Cl. ..... 261/39 B; 123/119 F; 261/64 C

[51] Int. Cl.[2] ..... F02M 1/10

[58] Field of Search ..... 123/119 F; 261/64 B, 261/64 C, 39 R, 39 A, 39 B, 65

[56] References Cited

UNITED STATES PATENTS

| | | | |
|---|---|---|---|
| 2,330,650 | 9/1943 | Weiche | 261/64 B |
| 2,362,346 | 11/1944 | Blake | 261/39 A |
| 2,624,325 | 1/1953 | Fricke et al. | 123/119 F |
| 2,949,102 | 8/1960 | Duntov | 261/39 B |
| 2,969,783 | 1/1961 | Braun | 123/119 F |
| 3,329,411 | 7/1967 | Offner | 261/39 R |
| 3,596,645 | 8/1971 | Mennesson | 261/50 A |
| 3,650,258 | 3/1972 | Jackson | 261/50 A |
| 3,791,358 | 2/1974 | Masaki et al. | 123/119 F |
| 3,807,710 | 4/1974 | Bergamini | 261/39 B |

*Primary Examiner*—Tim R. Miles
*Attorney, Agent, or Firm*—Haseltine, Lake & Waters

[57] ABSTRACT

A device which, when an engine is not yet running at a steady temperature, provides for the regulation of fuel-air ratio as a function of the engine temperature but independently of the flow rate of the air aspirated by the engine, by means of additional throttling means, upstream of the main throttling means. The additional throttling means are controlled by a device sensitive to the temperature of the running engine, so as to correspondingly adjust the density of the air aspirated by the engine only as a function of the engine temperature.

6 Claims, 1 Drawing Figure

AUTOMATIC DEVICE FOR EQUALIZING THE ADJUSTMENT OF THE CARBURETTER TO THE OPERATION OF AN ENGINE NOT YET RUNNING AT A STEADY TEMPERATURE

FIELD OF THE INVENTION

This invention relates to improvements in fuel supply systems in internal combustion engines.

After any fairly long stationary period, the walls of the aspiration pipes and also the inner walls of the cylinders of an internal combustion engine, particularly of a car parked in the open with low environmental temperature, are cooler or much cooler than their operating temperature when the engine is running at a steady temperature. It is in this regard well known that a part of the petrol mixed with the air in the carburetter tends to deposit on the said walls and in any case does not wholly take part in the combustion. The mixture that burns, therefore, is in such conditions weaker than when the engine is running steadily.

It is also known that in recent times, in order to reduce the pollution of the atmosphere caused by exhaust gases, the carburetter is adjusted so that, with the engine running steadily, it supplies an already somewhat weak mixture. The mixture further weakens when the engine is cold, and such weakening is greater as the engine is colder with respect to its steady-running temperature. This prevents or makes irregular both the ignition and the combustion of the mixture.

Manual and also automatic devices have long been known and widely used. They make it possible to alter, or else alter directly, the adjustment of the carburetter in order to allow even running of the engine in its aforesaid initial conditions, after starting. Such devices of the prior art, however, at the present time very often prove inadequate. In fact, if the device is manual, the use of mixtures that are already weak when the engine is running steadily (in connection with the problem of pollution of the atmosphere) makes it necessary to operate the manual device much more frequently than in the past and this makes excessive demands on the driver, who may also use the device too much, thus enriching the mixture more than is strictly necessary and consequently causing a considerable increase in atmospheric pollution.

However the automatic devices, both the traditional ones developed when the problem of pollution of the atmosphere had not yet arisen and those derived therefrom, are often inadequate. In respect of a given engine temperature, such devices do not bring about a percentage enrichment of the mixture identical, or almost identical, in the various conditions of engine output — with the result that, while the mixture provides even running in certain parts of the output range, in certain other parts it may be too weak (so as not to allow even running of the engine) or excessively rich (thus increasing non-burned exhaust effluent).

In order to clarify the situation further, it is recalled that the said devices are essentially of two types. The first of these is based on a valve comprising a fixed member and a movable member. In the fixed member some ducts open onto a generally plane surface, while the plane surface of the movable member, provided with other ducts, slides in contact with the first plane surface. In this way, the fixed ducts are placed more or less into communication with the movable ducts, and from this there follows a variation both of the feed and of the richness of the mixture in the idling and "progression" systems, or in any special enriching system. A problem encountered with this type of enrichment system is consequently that it does not appreciably vary the richness of the mixture at medium or high engine outputs. Moreover, the friction between the surfaces of the two members in contact makes it difficult to obtain a sufficiently precise adjustment (since in general there is no provision made for a servo-control between the temperature sensor and the device).

The second type of device is based on the use of a special primary throttle, or choke, which, in the engine inlet pipe, is placed upstream of the throttle valve. An essential character of the choke, however, is that it is positioned downstream on the intake of the small conduit taking the air into the upper part of the carburetter chamber and/or to the air checks of the emulsion block, and that it is positioned upstream with respect to all the pre-mixture outlet holes in the inlet pipe (both that of the "main" system close to the distributor and those of the idling and accelerating systems in the vicinity of the throttle valve).

If the choke is partly closed, the pressure drop obviously increases fuel feed through the jets. In a carburetter, the pressure differences which cause the basic fuel feed are notably diverse for the various systems. The said pressure differences are very great for the idling system (throttle partly closed), less great for the accelerating system, and very slight for the main system. The aforesaid pressure drop caused by the choke plus the said pressure differences clearly gives rise to very diverse enrichments. It is for this reason that provision is made for somewhat complex automatic mechanisms to enable the device to be employed in certain given conditions of use rather than in others. Despite such complication, fineness of adjustment does not always seem adequate.

SUMMARY OF THE INVENTION

It is an object of the invention to provide an improved fuel supply system for internal combustion engines.

The device according to the present invention, in order to satisfy the existing requirements (partly mentioned above), simultaneously presents the following characteristics: a) it is wholly automatic; b) the extent of the correction, understood as percent variation of the fuel/air ratio, is, for a certain engine temperature, practically constant throughout the whole engine output range, and is consequently independent of whether the fuel feed takes place through the main system, or through the accelerating system, or through the idling system; c) the extent of the aforesaid correction for every engine temperature is automatically supplied by the device; d) the device comprises a servo-mechanism and thus permits utilization of accurate temperature-sensing devices independently of their ability to do highly-efficient mechanical work with respect to the extent of the frictional forces of the controlled organ; e) the temperature sensing member can be positioned remotely from the carburetter and thus at the position in the engine most suitable for temperature sensing.

The variation of the fuel/air ratio is obtained in the device according to the present invention by using an air-flow throttling, for example a choke, placed upstream of the carburetter as in many known devices. In the present device, however, unlike what exists in normal choke arrangements, the said choke is positioned "wholly upstream" of the carburetter from the standpoint of carburetter functioning, whereas in the known devices the choke is positioned upstream of the carburetter but is downstream of the intake of the conduits which lead for example the air to the float chamber and/or to the air-checks of the emulsion block. In the said known devices, therefore, the choke is not functionally upstream of the carburetter but is inserted "into" the carburetter. As a result of this choice, in the device according to the present invention the choke is exclusively responsible for varying the density of the air entering the carburetter. It is known, and has also been theoretically demonstrated, that the fuel/air ratio at the carburetter outlet, understood as the ratio between parts by weight of air and parts by weight of fuel, is proportional to the square root of the ratio between the density of the incoming air and the density of the fuel; from this it follows that, if as a result of the pressure drop in the passage through the choke, the absolute pressure of the air (and thus its density) undergoes a decrease of for example 10%, then the mixture is enriched by approximately 5%, given that the richness of the mixture is multiplied by $1/\sqrt{0.9} \simeq 1/0.95 \simeq 1.05$. It is likewise known that this law applies in respect of a carburetter not only if the mixture is supplied by the main system (fuel fed by the effect of the depression of the venturi) but also when it is supplied by the idling and the accelerating systems (fuel fed by utilization of an appropriate portion of the depression caused by the main throttle valve). It is in relation to this consideration that in the device according to the invention, as is not the case with the traditional devices, it is possible to guarantee the characteristic b) above. If, in fact, for a given engine temperature the device causes a certain pressure drop of the air in the region of the choke, and if this pressure drop is kept constant by the device in all conditions of use of the engine (i.e., independently of the amount of air drawn-in), then in all these conditions the variation in density of the incoming air is always the same, and thus the percent variation of the fuel/air ratio is also always the same.

In the device according to the present invention, the choke, on varying the flow rate of the intake air, is automatically positioned so as to maintain at a constant value (at a given temperature of the engine) the consequent pressure drop. The opening level of the choke is in fact dependent on the position of a movable wall, the latter being subject to a pressure differential depending on the above mentioned pressure drop, and to the action a counter spring, highly yieldable and suitably preloaded. The differential pressure acting on the two opposite surfaces of the movable wall is a part of the afore said pressure drop because for example the space surrounding one of the two surfaces is connected through a calibrated port with the duct downstream of the choke (in which the afore said pressure exists), but is is also connected, through a second port of variable area, depending on the temperature of the engine, with the zone upstream of the choke. On the said surface of the movable wall is thus acting a pressure level intermediate between those upstream and downstream of the choke. As the other surface is subjected to the upstream existing pressure, the movable wall is on the whole subjected to the effect of a "part" of the depression caused by the choke. The value of said "part" is dependent on the areas of the above mentioned ports, and, the calibrated port being fixed, more particularly on the area of the second part.

In the present device this area is, for example, the annular one uncovered by a conical shaped needle, which partially enters a circular hole: the conical needle being linked to a member sensing the temperature of the engine, (e.g. a bimetallic element immersed into the engine liquid coolant), at every temperature of the engine, a different penetration level of the needle into the hole, and therefore a different area of the second port, does correspond. If $\Delta P_o$ is the value of the pressure differential acting on the two surfaces of the movable wall, at which the preload of the spring is equilibrated (account being taken of the active surface of the movable wall); if $S_1$ is the area of the variable port uncovered by the conical needle; if $S_2$ is the area of the aforesaid calibrated port; it is readily calculated that the pressure drop across the choke is:

$$\Delta P = \Delta P_o \left(1 + \left(\frac{S_1}{S_2}\right)^2\right)$$

The pressure drop shall be thus minimum (and equal to $\Delta P_o$) when the area $S_1$ is zero, (i.e., the needle is against the seat, and the engine is warmed up), and the higher is the area $S_1$, the greater is this pressure drop.

If, at the inlet of the carburetter, p is the absolute pressure, when the engine is warmed up, the enrichment rate of the mixture, when the engine is cold (i.e., the ratio between the fuel proportion of the mixture when the engine is cold and that when the engine is warmed up) is, as above stated:

$$a = \sqrt{\frac{P}{p-\Delta p}} \qquad \sqrt{\frac{p}{p-\Delta P_o\,(1+(S_1/S_2)^2)}}$$

By properly shaping the needle with respect to the characteristics of the element sensing the temperature $t$ of the engine, values $S_1$ as a function of $t$ can be obtained, which can give place to the enrichment rates "$a$" required by the engine, these rates being also function of $t$:

$$a(t) = \sqrt{\frac{p}{P\Delta P_o\,(1+(S_1(t)/S)^2)}}$$

The preceding considerations were referred to the case of an automatic enrichment device for an engine fed through a carburetter. Obviously the subject device could be also used in the case of a fuel feeding taking place by injection, especially if the amount of the injected fuel is not adjusted on the basis of the pressure inside the intake duct: on the contrary, for the injection feeding, the variations of density of the incoming air (as caused by the pressure drop across the choke) give place to greater variations of the mixture ratio; the latter is in fact proportional to the air density and not to the square root of said density, whereby the desired correction is more easily achieved, namely for lower pressure drop across the choke.

BRIEF DESCRIPTION OF THE DRAWING

The above description is next further clarified, by considering the FIG. 1, in which, by example only and not in limitative sense, a preferred embodiment of the subject device is shown.

The duct for the passage of the air sucked by the engine comprises a first length, generally indicated by the reference 1, in which the choke 3 is mounted and the venturi 4 is formed, and a second length, generally indicated by the reference 2, in which the throttle valve 6 is mounted downstream of the venturi 5, the passages of the pre-mixture of fuel and air fed to the engine through the several systems (main, idling and accelerating) opening thereinto. In FIG. 1, only the nozzle 7 is shown, by which the pre-mixture is fed for the engine operation at medium and high outputs.

Figure 1:
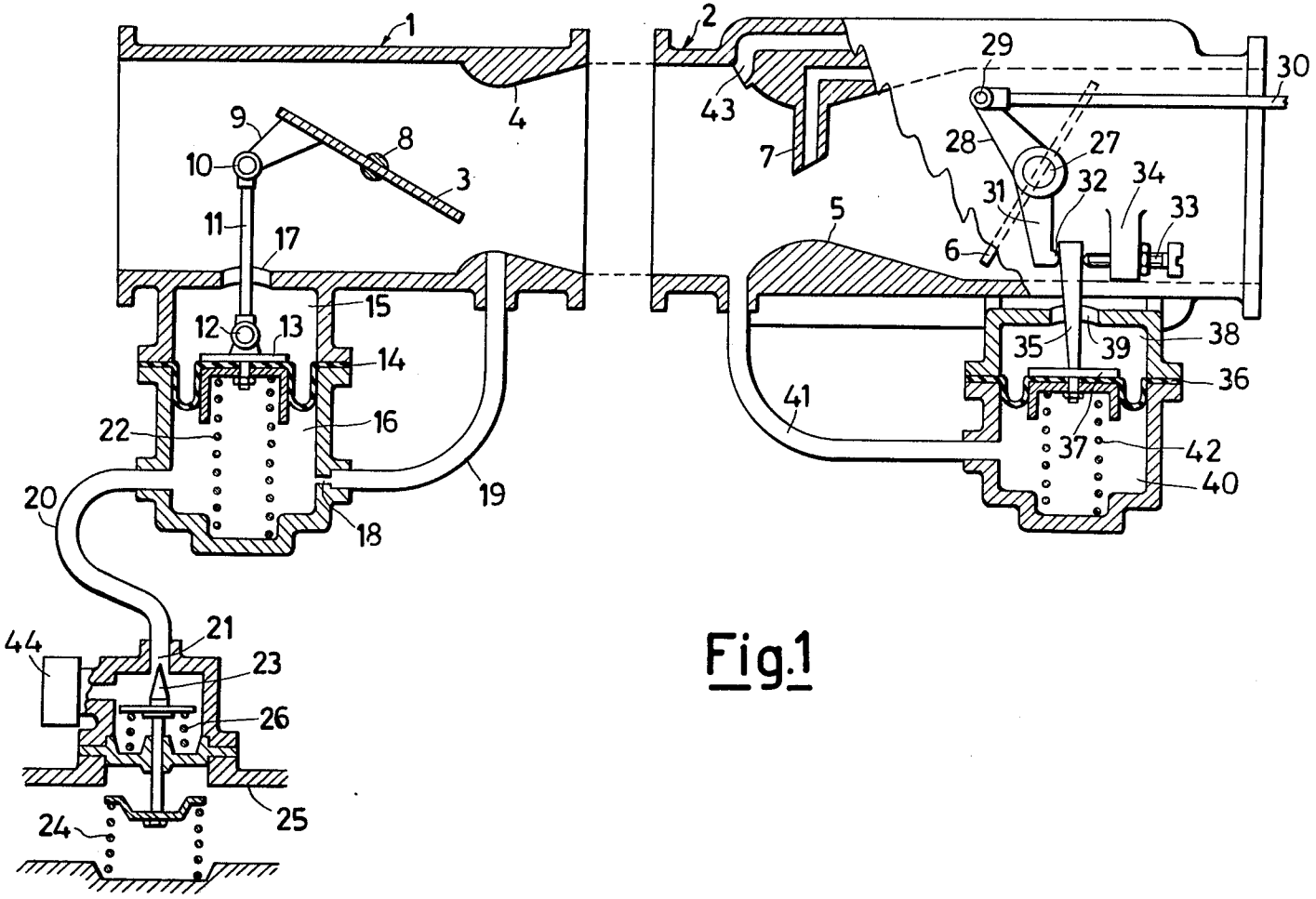
In FIG. 1, the sole FIGURE, a carburetter is partly illustrated, which feeds the engine of a motor vehicle.

The choke shaft 8 is rotatably mounted in the duct 1. An arm 9 is rigidly mounted on the body of the choke and is pivoted at 10 to the rod 11 in turn rotatably pivoted at 12 to the disc 13, the latter being secured to the central part of the deformable membrane 14.

The membrane 14 separates the two small chambers 15 and 16, the former communicating through the hole 17 with the zone of the duct 1 upstream of the choke 3, and the latter communicating through the calibrated port 18 and the passage 19 with the zone of the duct 1 downstream of the choke, and precisely at the restricted cross section of the venturi, and being also into communication through the duct 20 and the variable section area port 21 with the outer space. The force acting on the member 14, due to the pressure differential acting on both surfaces thereof is balanced by the spring, which is mounted inside the chamber 16 and is suitably preloaded.

The external air arriving to the port 21 is filtered at 44. A conic needle valve 23 is mounted at the port 21. The stem of the valve is linked to the temperature sensing device 24, mounted inside the duct 25, through which the liquid coolant of the engine is passed. The section area of the port 21 uncovered by the valve 23 takes different values depending on the temperature of the engine and is the greatest when the engine is cold. A spring 26 acts on the valve so as to close the port 21 when the contrasting action of the temperature sensing device is lacking, as the engine has attained the steady running temperature.

The throttle valve 6 is rigid with the shaft 27, rotatably mounted within the duct 2. The same shaft 27 bears a two armed lever, one arm, shown by the reference 28, being connected at 29 to the tie rod 30 linked to the accelerating pedal, not shown. On the other arm of the lever, bearing the reference 31, a projection 32 is provided engaging, under the action of a return spring (not shown), a limit stop adapted to keep the throttle 6 in the position of minimum opening.

The stop comprises the screw 33 manually adjustable in the support 34 and the wedge-shaped shim 35, which is controlledly slidable between the projection 32 and the same screw 33 by the deformable membrane 36, due to the rigid engagement with the disc 37 in turn secured to the central part of the membrane 36.

The force acting on the membrane 36 due to the pressure difference on the two surfaces thereof is balanced by the load of the spring 42. The reference 43 indicates a small duct, derived from the air passage duct, downstream of the choke 3, which feeds the air checks of the fuel mixing chambers (not shown) and communicates with the crown of the fuel float chamber (not shown).

During the warming up, after the starting, the air sucked by the engine passes through the section of the duct 1 which is left open by the choke 3 and through the section of the duct 1 left open by the butterfly throttle 6. Due to the depression occurring within the duct 1 downstream of the choke, the membrane 36 is displaced, thus pressing the spring 42 and drawing the wedge 35, whereby a greater thickness is interposed between the screw 33 and the projection 32. The throttle 6 is rotated assuming a limit position (accelerating pedal completely released) at which a greater opening rate occurs with respect to that of the idle running at steady temperature, so that the air flow rate sucked by the engine is increased. The depression in the duct 1, downstream of the choke 3, is sensed also by the membrane 14, but, until the engine is running at steady temperature, and the port 21 is partly uncovered by the valve 23, the depression sensed by the membrane 14 is only a part of the depression existing within the duct 1, downstream of the choke. As before illustrated, the depression within the chamber 16 is lower than the depression existing within the duct 1 by an amount depending on the ratio between the passage section of the port 21 and that of the calibrated port 18. Due to this depression the choke is driven so as to uncover in the duct 1 an air passage section lower than that which would take place without the correction carried out as a function of the engine temperature and, the flow rate by volume of the suction air being the same, the pressure differential across the choke is greater than that occurring under the same conditions when the engine is at steady running temperature. At lower values of the pressure downstream of the choke, lower figures of the specific gravity of the engine suction air correspond as well as a consequent automatic enrichment of the feeding fuel-air mixture.

The enrichment rate of the fuel-air mixture varies with the temperature of the engine and decreases as the temperature increases, but at a given temperature it has a well defined value and remains constant on varying the air suction flow rate during the warming up phase, since the membrane 14 is acting on the choke 3 so as to maintain essentially constant the pressure drop and therefore the air density regardless of any flow rate variation. The crown of the fuel float chamber is at the same pressure conditions as the portion of the duct 1 downstream of the choke, and also the air feeding to the air checks of the fuel mixing chambers is as the same pressure as that existing within the duct 1 downstream of the choke, whereby a uniform enrichment of the pre-mixture delivered by the mixing chambers of the several systems, namely idle running, accelerating and main feeding, takes place and thus a homogeneous enrichment of the fuel-air mixture fed to the engine on varying the feeding flow rate.

When the engine attains the steady running temperature, the valve 23 closes the port 21 and, in the chamber 16, the same depression exists as that downstream of the choke 3. In increasing the air suction flow rate, due to the opening of the throttle 6 under the driver's control by means of the accelerator pedal, the choke 3 opens up to leave almost completely uncovered the air passage section in the duct 1. The fast opening of the choke is caused by the fact that the duct 19 is derived from the restricted section of the venturi 4 and, when the air flow rate increases, the venturi causes rapidly increasing pressure variations in the air.

Owing to the lower value of the depression which, when, the engine is steadily running, exists in the duct 2 downstream of the venturi 5, the membrane 36 causes the wedge 35 to be displaced so that a lower thickness is interposed between the screw 33 and the projection 32. Such a lower thickness is dependent on the position of minimum opening of the throttle (accelerator pedal released), which is pre-set for the idle running at steady temperature.

In an injection type engine, the arrangement of the several components of the device is alike to that shown for a carburetter engine. Of course, in the suction duct of the engine there shall be omitted those components which are characteristic of a carburetter, namely the venturi 5 and the means forming the fuel-air mixture and adjusting the fuel-air ratio, comprising the main feeding system 7, the idle running system and the accelerating system.

What is claimed is:

1. In an internal combustion engine, particularly for automotive vehicles, which is provided with first means suitable forming an aspirated mixture having a fuel/air ratio and for regulating the fuel/air ratio of said mixture for the functioning of the engine with the engine running at a steady temperature, an inlet pipe feeding said first means, and further provided with second means for throttling the aspirated air, possibly already mixed with fuel, the last said means being such as to permit regulation of the power output, a device for the automatic correction of said fuel/air ratio to allow the operation of the engine when the engine is not running at a steady temperature, said device comprising third means for throttling the aspirated air, such third means being arranged in the inlet pipe wholly upstream of said first means for forming and regulating the mixture and also wholly upstream of the second means, fourth means for regulating the third means, and a member sensitive to engine temperature, said fourth means being operationally connected to said member which is sensitive to the engine temperature, said fourth means also being responsive to the air flow rate in said inlet pipe and actuating the said third means in such a way that at a given value of said temperature the pressure-drop caused in the aspirated air by said third means comes to have a corresponding value and that such value remains constant against variation of the amount of air aspirated, there thus corresponding to each value of the aforesaid temperature a particular value of said pressure-drop, such pressure-drop being minimal with the engine running at a steady temperature and higher as engine temperature is lower, the correction of the fuel/air ratio with the engine not running at a steady temperature deriving solely from the fact that, downstream of the device the density of the aspirated air is altered, being decreased by the effect of the aforesaid pressure-drop.

2. A device according to claim 1, wherein said fourth means for regulating said third means comprises a movable wall having two surfaces, the pressure difference acting on the two surfaces of said wall being a part of the pressure drop caused in the aspirated air by said third means, said fourth means being provided with two spaces respectively in contact with the surfaces of the movable wall and being in communication with a zone upstream and a zone downstream of said third means in the inlet pipe, said device further comprising a throttling valve and a duct coming into one of the two aforesaid spaces, said throttling valve being positioned in the latter said duct, said duct having an area of restricted section which, depending on the valve, controls the value of the ratio between the difference of the pressures acting on the two surfaces of the movable wall and the pressure drop caused in the aspirated air by said third means, said valve including a movable member actuated by said member sensitive to the engine temperature, whereby to each value of the engine temperature a determined position of the movable member of the valve and thus a determined value of said part of the pressure drop corresponds, said fourth means comprising a linkage between the aforesaid movable wall and the movable member, and a spring, having high yieldability and being preloaded, the action of said spring opposing the resultant force of the pressures acting on the two surfaces of the movable wall; at a given temperature of the engine and at every value of the flow rate of air aspirated by the engine the movable wall and thus the third means linked to the movable wall, taking the particular position at which the pressure drop which, in view of the aforesaid fuel/air ratio, gives way to the pressure difference between the two surfaces of the movable wall the resultant of which is in equilibrium with the preload of the spring, a variation of the air flow rate aspirated by the engine causing the ready displacement of the moveable wall and of the said third means to restore the pressure drop predetermined for a given engine temperature.

3. A device according to claim 2 further comprising, for the idle running of the engine not at a steady temperature, means for the automatic correction of the maximum closure extent of said second means for regulating the delivered engine output, said correction means including a member sensitive to the depression existing upstream of said second means and, therefore, downstream of said third means, said member sensitive to the depression including a movable part, a member acting as limiting stop of the closure of said second means, said limiting stop including a fixed stop and a movable stop member and being adapted for varying the position of maximum closure of said second means, a linkage between the movable part of said member sensitive to the depression and said stop member, to every value of the engine temperature there being a corresponding value of said depression, and thus a particular position of the movable part of the said sensitive member, a particular position of the stop member, and a particular closure extent of said throttling means.

4. A device according to claim 3, wherein said throttling means includes a striking element which engages said fixed stop element through said movable stop member, said movable stop member being shaped so as to have a variable thickness section, said movable member being linked to the movable part of the member sensitive to the said depression, to each value of said depression there being corresponding a particular position of said movable member with respect to the fixed member, and thus a particular value of the thickness interposed between the striking element and the fixed stop member, the closure extent of said second means being dependent on the value of said thickness.

5. In an internal combustion engine, particularly for automotive vehicles, which is provided with first means suitable forming an aspirated mixture having a fuel/air ratio and for regulating the fuel/air ratio of said mixture for the functioning of the engine with the engine running at a steady temperature, an inlet pipe feeding said first means, the said first means consisting of a carburetor and further provided with means for throttling the aspirated air, possibly already mixed with fuel, the last said means being such as to permit regulation of the power output, a device for the automatic correction of said fuel/air ratio so as to allow the operation of the engine when the engine is not running at a steady temperature, said device comprising third means for throttling the aspirated air, said third means being arranged in the inlet pipe wholly upstream of the first means for forming and regulating the mixture and also wholly upstream of the second means and fourth means for regulating the third means and a member sensitive to engine temperature, said fourth means also being responsive to the air flow rate in said inlet pipe and being operationally connected to said member which is sensitive to the engine-temperature, said regulation means actuating the third means in such a way that at a given value of said temperature the pressure-drop caused in the aspirated air by said third means comes to have a corresponding value and that such value remains constant against variation of the amount of air aspirated, there thus corresponding to each value of the aforesaid temperature a particular value of said pressure-drop, such pressure-drop being minimal with the engine running at a steady temperature and higher as engine-temperature is lower, the correction of the fuel/air ratio with the engine not running at a steady temperature deriving solely from the fact that, downstream of the device, the density of the aspirated air is altered, being decreased by effect of the aforesaid pressure-drop.

6. In an internal combustion engine, particularly for automotive vehicles, which is provided with first means suitable for forming an aspirated mixture having a fuel-/air ratio and for regulating the fuel/air ratio of said mixture for the functioning of the engine with the engine running at a steady temperature, an inlet pipe feeding said first means, said first means consisting of a fuel injection system, and second means for throttling the aspirated air, the last said means being such as to permit the regulation of the power output, a device for the automatic correction of said fuel/air ratio to allow the operation of the engine when the engine is not running at a steady temperature, said device comprising third means for throttling the aspirated air, said third means being arranged in the inlet pipe wholly upstream of the first means for forming and regulating the mixture and also wholly upstream of the said second means, and a member sensitive to engine temperature, fourth means operationally connected to said member which is sensitive to the engine temperature, said fourth means also being responsive to the air flow rate in said inlet pipe and actuating the said third means in such a way that at a given value of said temperature the pressure-drop caused in the aspirated air by said third means comes to have a corresponding value and that such value remains constant against variation of the amount of air aspriated, there thus corresponding to each value of the aforesaid temperature a particular value of said pressure-drop, such pressure-drop being minimal with the engine running at a steady temperature and higher as engine-temperature is lower, the correction of the fuel/air ratio with the engine not running at a steady temperature deriving solely from the fact that, downstream of the device, the density of the aspirated air is altered, being decreased by effect of the aforesaid pressure-drop.

* * * * *